US007533540B2

(12) United States Patent
Prosser

(10) Patent No.: US 7,533,540 B2
(45) Date of Patent: May 19, 2009

(54) CRYOGENIC AIR SEPARATION SYSTEM FOR ENHANCED LIQUID PRODUCTION

(75) Inventor: Neil Mark Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 367 days.

(21) Appl. No.: 11/372,153

(22) Filed: Mar. 10, 2006

(65) Prior Publication Data

US 2007/0209389 A1 Sep. 13, 2007

(51) Int. Cl.
*F25J 3/00* (2006.01)

(52) U.S. Cl. ..... 62/645; 62/646

(58) Field of Classification Search ..... 62/645, 62/646

See application file for complete search history.

(56) References Cited

U.S. PATENT DOCUMENTS

| | | | | | |
|---|---|---|---|---|---|
| 3,905,201 | A | | 9/1975 | Coveney et al. | 62/13 |
| 4,555,256 | A | * | 11/1985 | Skolaude et al. | 62/646 |
| 4,883,518 | A | * | 11/1989 | Skolaude et al. | 62/646 |
| 5,108,476 | A | | 4/1992 | Dray et al. | 62/24 |
| 5,157,926 | A | * | 10/1992 | Guilleminot | 62/646 |
| 5,329,776 | A | | 7/1994 | Grenier | 62/24 |
| 5,400,600 | A | * | 3/1995 | Grenier | 62/646 |
| 5,475,980 | A | | 12/1995 | Grenier et al. | 62/24 |
| 5,511,381 | A | * | 4/1996 | Higginbotham | 62/646 |
| 5,596,885 | A | | 1/1997 | Grenier | 62/646 |
| 5,660,059 | A | * | 8/1997 | Higginbotham | 62/646 |
| 5,802,873 | A | | 9/1998 | Howard | 62/646 |
| 5,806,341 | A | * | 9/1998 | Rathbone | 62/646 |
| 5,934,105 | A | | 8/1999 | Bonaquist et al. | 62/646 |
| 6,000,239 | A | | 12/1999 | Bonaquist et al. | 62/646 |
| 6,141,990 | A | * | 11/2000 | De Bussy et al. | 62/647 |
| 6,220,053 | B1 | | 4/2001 | Hass, Jr. et al. | 62/613 |
| 6,227,005 | B1 | * | 5/2001 | Higginbotham et al. | 62/646 |
| 6,463,758 | B1 | * | 10/2002 | Le Bot | 62/654 |
| 6,962,062 | B2 | * | 11/2005 | Ha et al. | 62/654 |
| 2006/0010912 | A1 | | 1/2006 | Brugerolle et al. | |

FOREIGN PATENT DOCUMENTS

| | | | |
|---|---|---|---|
| EP | 0672878 | A1 | 9/1995 |
| EP | 0752566 | A1 | 1/1997 |
| EP | 0828124 | A2 | 3/1998 |
| GB | 2335974 | A | 10/1999 |

* cited by examiner

*Primary Examiner*—William C Doerrler
(74) *Attorney, Agent, or Firm*—David M. Rosenblum

(57) ABSTRACT

A system for separating air by cryogenic rectification whereby liquid production is increased by employing two separate turboexpanders, one which exhausts at a pressure no higher than that sufficient to feed the lower pressure column, the other which exhausts at a pressure no lower than that sufficient to feed the higher pressure column, and wherein one of the turboexpanders is fed with ambient temperature or modestly cooled feed air and preferably operates intermittently depending upon whether greater or lesser amounts of liquid product are desired.

7 Claims, 6 Drawing Sheets

CRYOGENIC AIR SEPARATION SYSTEM FOR ENHANCED LIQUID PRODUCTION

TECHNICAL FIELD

This invention relates generally to cryogenic air separation and, more particularly, to cryogenic air separation for producing enhanced amounts of liquid product.

BACKGROUND ART

Cryogenic air separation is a very energy intensive process because of the need to generate low temperature refrigeration to drive the process. This is particularly the case where large amounts of liquid product are recovered which necessarily removes large amounts of refrigeration from the system. Accordingly, a method for operating a cryogenic air separation plant which enables efficient operation in a low liquid producing mode as well as in a high liquid producing mode would be very desirable.

SUMMARY OF THE INVENTION

A method for operating a cryogenic air separation plant employing a double column having a higher pressure column and a lower pressure column comprising:

(A) passing a first gas stream having a temperature within the range of from 125K to 200K to a cold turbine, turboexpanding the first gas stream in the cold turbine to a pressure no greater than 3 psi higher than the operating pressure of the lower pressure column, and passing the turboexpanded first gas stream into at least one of the lower pressure column, the atmosphere, and a product stream; and (B) passing a second gas stream having a temperature within the range of from 200K to 320K to a warm turbine, turboexpanding the second gas stream in the warm turbine to a pressure no lower than the operating pressure of the higher pressure column, and passing the turboexpanded second gas stream into at least one of the higher pressure column and the cold turbine.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, The Continuous Distillation Process. A double column comprises a higher pressure column having its upper end in heat exchange relation with the lower end of a lower pressure column.

Vapor and liquid contacting separation processes depend on the difference in vapor pressures for the components. The higher vapor pressure (or more volatile or low boiling) component will tend to concentrate in the vapor phase whereas the lower vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "feed air" means a mixture comprising primarily oxygen, nitrogen and argon, such as ambient air.

As used herein, the terms "upper portion" and "lower portion" of a column mean those sections of the column respectively above and below the mid point of the column.

As used herein, the terms "turboexpansion" and "turboexpander" or "turbine" mean respectively method and apparatus for the flow of high pressure fluid through a turbine device to reduce the pressure and the temperature of the fluid, thereby generating refrigeration.

As used herein, the term "cryogenic air separation plant" means the column or columns wherein feed air is separated by cryogenic rectification to produce nitrogen, oxygen and/or argon, as well as interconnecting piping, valves, heat exchangers and the like.

As used herein, the term "compressor" means a machine that increases the pressure of a gas by the application of work.

As used herein, the term "subcooling" means cooling a liquid to be at a temperature lower than the saturation temperature of that liquid for the existing pressure.

As used herein, the term "operating pressure" of a column means the pressure at the base of the column.

Figure 1:
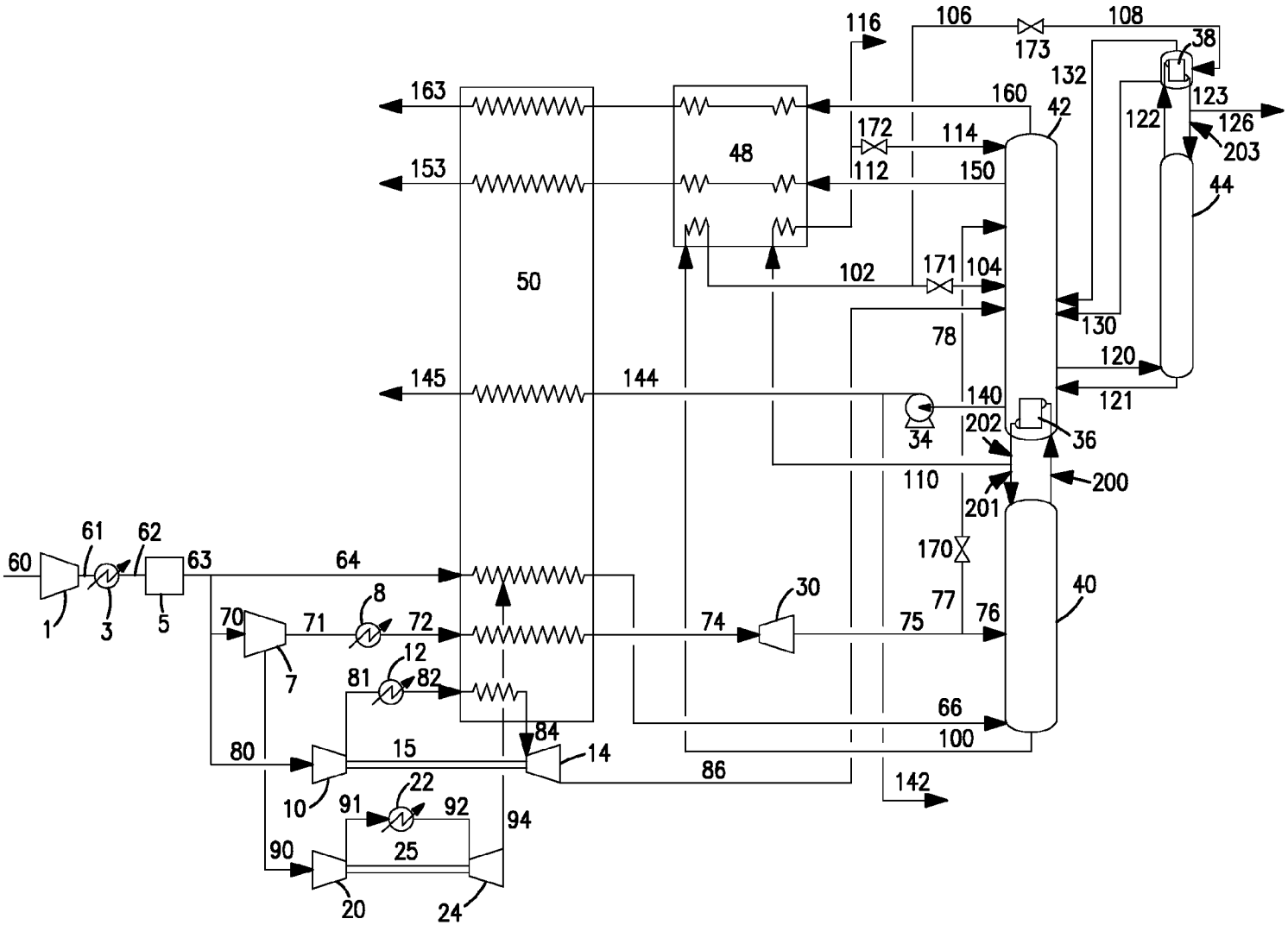
FIGS. 1-5 are schematic representations of preferred arrangements for the practice of the cryogenic air separation method of this invention.

The numerals in the Drawings are the same for the common elements.

DETAILED DESCRIPTION

In general, the invention is a method for operating a cryogenic air separation plant wherein a gas stream, which may be feed air or nitrogen-enriched vapor from the higher pressure column, and having a temperature generally within the range of from 125K to 200K, more preferably from 140K to 190K, is turboexpanded through a first turbine, termed the cold turbine, to a pressure no greater than 3 pounds per square inch (psi) higher than the operating pressure of the lower pressure column. The discharge from the cold turbine is passed into the lower pressure column and/or vented to the atmosphere or recovered as product. During at least some of the time that the cold turbine is operating, a feed air stream having a temperature generally within the range of from 200K to 320K, more preferably from 280K to 320K, is turboexpanded through a second turbine, termed the warm turbine, to a pressure no lower than the operating pressure of the higher pressure column. The discharge from the warm turbine is passed into the higher pressure column and/or the cold turbine. By terminating the flow of pressurized air to the warm turbine and booster, or shutting down its feed compressor, the warm turbine can be turned off in order to reduce power consumption when less liquid product production is desired. In addition, the supply flow to and/or the inlet pressure of the warm turbine and booster can be modulated within normal operating ranges depending upon whether a greater or lesser amount of liquid product production is desired.

The invention will be described in greater detail with reference to the Drawings. The cryogenic air separation plant illustrated in the Drawings comprises a double column, having a higher pressure column 40 and a lower pressure column 42, along with an argon column 44. The cold turbine is identified by the numeral 14 and the warm turbine is identified by the numeral 24.

Figure 2:
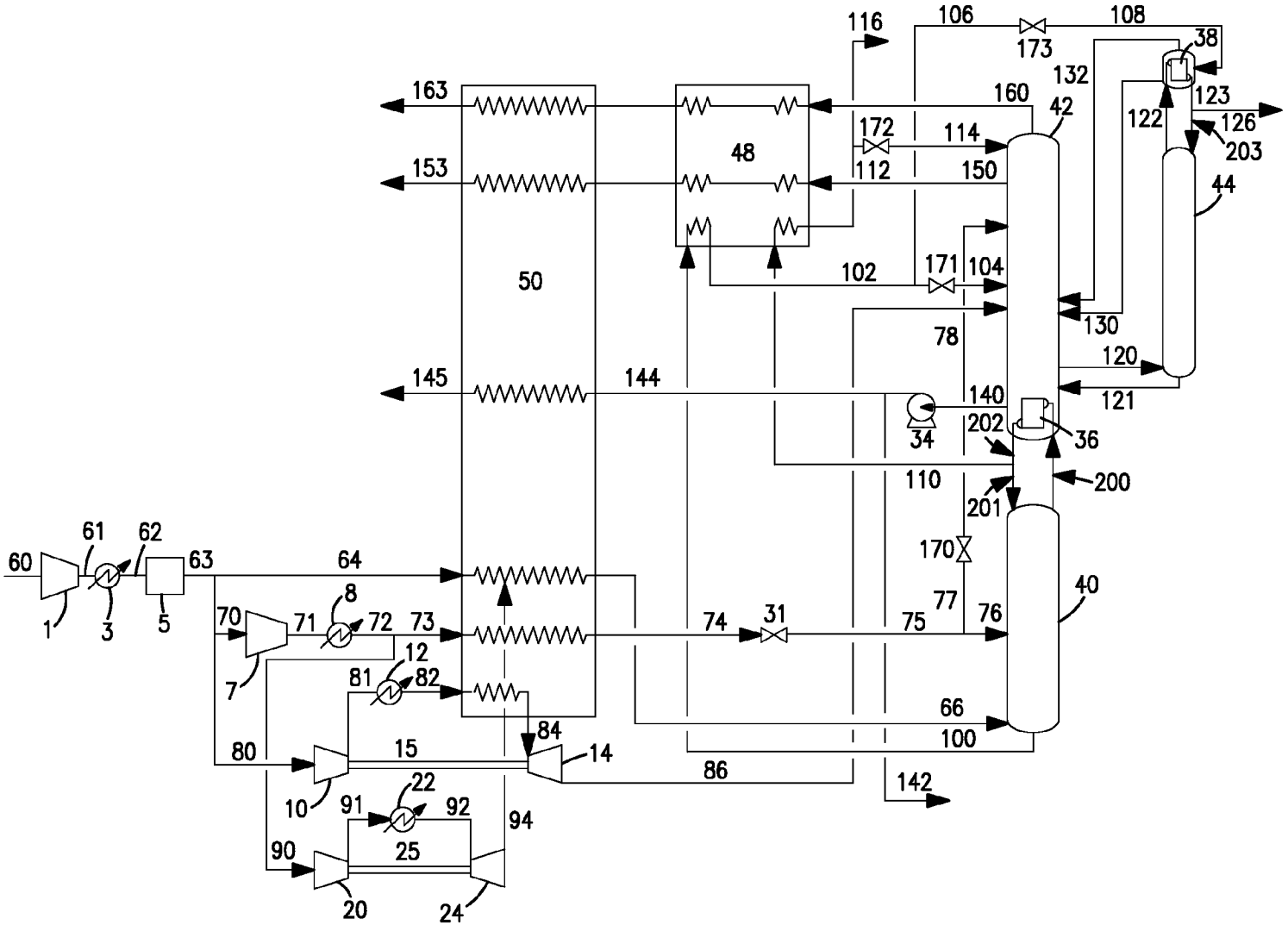

Referring now to FIG. 1, feed air 60 is compressed in compressor 1 and compressed feed air stream 61 is cooled in aftercooler 3 to produce stream 62. After compression to sufficient pressure to supply the high pressure column, and aftercooling, air stream 62 is passed through prepurifier 5. Stream 63 is split between streams 64, 70, and 80. Stream 64 represents the largest portion of stream 63. It is fed directly to primary heat exchanger 50, where it is cooled to slightly above its dew point temperature and is fed as stream 66 to the base of high pressure column 40. Booster air compressor 7 compresses air stream 70 to produce compressed streams 71 and 90. The discharge pressure of compressor 7 (stream 71 pressure) is related to the pressure of the pumped liquid oxygen entering heat exchanger 50 (stream 144). The flow of stream 71 is generally 26%-35% of the total air flow. After passing through aftercooler 8, stream 72 is cooled and condensed (or pseudo-condensed if it is above the supercritical pressure) in heat exchanger 50. Stream 74 is let down in pressure in liquid turbine 30 to sufficient pressure to supply high pressure column 40. Liquid turbine 30 is replaced by a throttle valve 31 at the lower oxygen boiling pressures as shown in FIG. 2. Stream 75 is split so a portion 76 of the liquid air flow is introduced into high pressure column 40, several stages above the bottom, and the remaining portion 77 is reduced in pressure through throttle valve 170 and introduced as stream 78 into the low pressure column.

Stream 90 is shown being withdrawn interstage from compressor 7, preferably after the first or second stage of compression. The pressure of stream 90 can range from 130 pounds per square inch absolute (psia) to 400 psia. Stream 90 is withdrawn after an intercooler, which is not shown, so it is cooled to near ambient temperature. If the pumped liquid oxygen pressure is low, it is possible that the discharge pressure of compressor 7 is satisfactorily high for stream 90. In that case, stream 90 is withdrawn as a split stream from stream 72, after passing through aftercooler 8 as shown in FIG. 2. FIG. 2 shows a variation of the FIG. 1 arrangement with a relatively low pumped oxygen pressure. Throttle valve 31 is employed instead of the liquid turbine.

Warm turbine 24 driving booster 20 is an important component of this invention. Stream 90 is raised in pressure in booster compressor 20, which is driven by the work energy withdrawn by turbine 24 through shaft 25. The pressure of stream 91 can range from 220 psia to 900 psia. After cooling to near ambient temperature in cooler 22, stream 92 is reduced in pressure in turbine 24. Stream 94 exhausts at a pressure that is no lower than the operating pressure of the higher pressure column which is generally within the range of from 60 to 100 psia. The stream 94 temperature can be as low as about 155K and as high as about 240K. Primary heat exchanger 50 is preferably designed with a side header at the optimal temperature level. Stream 94 is combined with the main feed stream supplying the high pressure column upon entry into the side header of heat exchanger 50. The self-boosted arrangement of the warm turbine (20, 24, 25) greatly increases the pressure ratio across the turbine for a given pressure of stream 90. Doing so minimizes the required flow through turbine 24. This is important because flow through turbine 24 is diverted from the warm end of heat exchanger 50. The higher the flow through turbine 24, the greater the warm end temperature difference in heat exchanger 50. This represents an increased refrigeration loss. The turbine/booster arrangement shown for 20 and 24 is preferred as it gives nearly ideal non-dimensional parameters that lead to an efficient aerodynamic design without the need for gearing. Given this, however, it is conceivable that an alternative turbine/booster configuration is used for 20 and 24, or that a generator is used as the turbine loading device rather than booster 20.

The cold turbine in the embodiment illustrated in FIG. 1 expands feed air to the lower pressure column. Combining the warm turbine/booster with turbine expansion to the lower pressure column or some other turbine arrangement (such as expansion of nitrogen-enriched vapor from the higher pressure column) that is efficient for no liquid production is preferred. The self-boosted turbine configuration shown is often preferred. Here, stream 80 is boosted in pressure in compressor 10, which is driven by cold turbine 14 through shaft 15. This also increases the pressure ratio across turbine 14, decreasing the required flow, and giving better argon and oxygen recovery. Resulting stream 81 passes through cooler 12, and resulting stream 82 is cooled to an intermediate temperature in heat exchanger 50. The temperature of stream 84 typically can be as low as 125K and as high as 200K and preferably is within the range of from 140K to 190K. After exhausting to a pressure no greater than 3 psi above the operating pressure of the lower pressure column, stream 86 is fed to the appropriate stage in lower pressure column 42. In an alternative arrangement that also maintains a relatively low flow through this unit, stream 80 is withdrawn after the first stage of compressor 70 (possibly in combination with stream 90), fed directly to heat exchanger 50, partially cooled, and fed to turbine 14. Here, the cold turbine is loaded with a generator and its pressure ratio is still high due to the compression of stream 80 in the first stage of compressor 70.

Within higher pressure column 40 the feed air is separated by cryogenic rectification into nitrogen-enriched vapor and oxygen-enriched liquid. Nitrogen-enriched vapor is withdrawn from the upper portion of higher pressure column 40 as stream 200 and is condensed by indirect heat exchange with lower pressure column 42 bottom liquid in main condenser 36. A portion 201 of the resulting condensed nitrogen-enriched liquid 202 is returned to higher pressure column 40 as reflux. Another portion 110 of the resulting condensed nitrogen-enriched liquid is subcooled in heat exchanger 48. Resulting subcooled nitrogen-enriched liquid 112 is passed through valve 172 and as stream 114 into the upper portion of lower pressure column 112. If desired, a portion 116 of stream 62 may be recovered as liquid nitrogen product.

Oxygen-enriched liquid is withdrawn from the lower portion of higher pressure column 40 in stream 100, subcooled in heat exchanger 48 to produce stream 102, passed through valve 171 and then passed into lower pressure column 42 as stream 104. In the illustrated embodiments the cryogenic air separation plant also includes argon production. In these embodiments a portion 106 of oxygen-enriched liquid 102 is passed through valve 173 and as stream 108 is passed into argon column top condenser 38 for processing as will be further described below.

Lower pressure column 42 is operating at a pressure generally within the range of from 16 to 26 psia. Within lower pressure column 42 the various feeds are separated by cryogenic rectification into nitrogen-rich vapor and oxygen-rich liquid. Nitrogen-rich vapor is withdrawn from the upper portion of lower pressure column 42 in stream 160, warmed by passage through heat exchanger 48 and main heat exchanger 50, and recovered as gaseous nitrogen product in stream 163. For product purity control purposes waste nitrogen stream 150 is withdrawn from column 42 below the withdrawal level of stream 160, and after passage through heat exchanger 48 and main heat exchanger 50 is removed from the process in stream 153. Oxygen-rich liquid is withdrawn from the lower portion of lower pressure column 42 in stream 140 and pumped to a higher pressure by cryogenic liquid pump 34 to form pressurized liquid oxygen stream 144. If desired, a portion 142 of stream 144 may be recovered as liquid oxygen product. The remaining portion is vaporized by passage through main heat exchanger 50 by indirect heat exchange with incoming feed air and recovered as gaseous oxygen product in stream 145.

A stream comprising primarily oxygen and argon is passed in stream 120 from column 42 into argon column 44 wherein it is separated into argon-enriched top vapor and oxygen-richer bottom liquid which is returned to column 42 in stream 121. The argon-enriched top vapor is passed as stream 122 into argon column top condenser 38 wherein it is condensed against partially vaporizing oxygen-enriched liquid provided to top condenser 38 in stream 108. The resulting condensed argon 123 is returned to column 44 in stream 203 as reflux and a portion 126 of stream 123 is recovered as liquid argon product. The resulting oxygen-enriched fluid from top condenser 38 is passed into lower pressure column 42 in vapor stream 132 and liquid stream 130.

Figure 6:
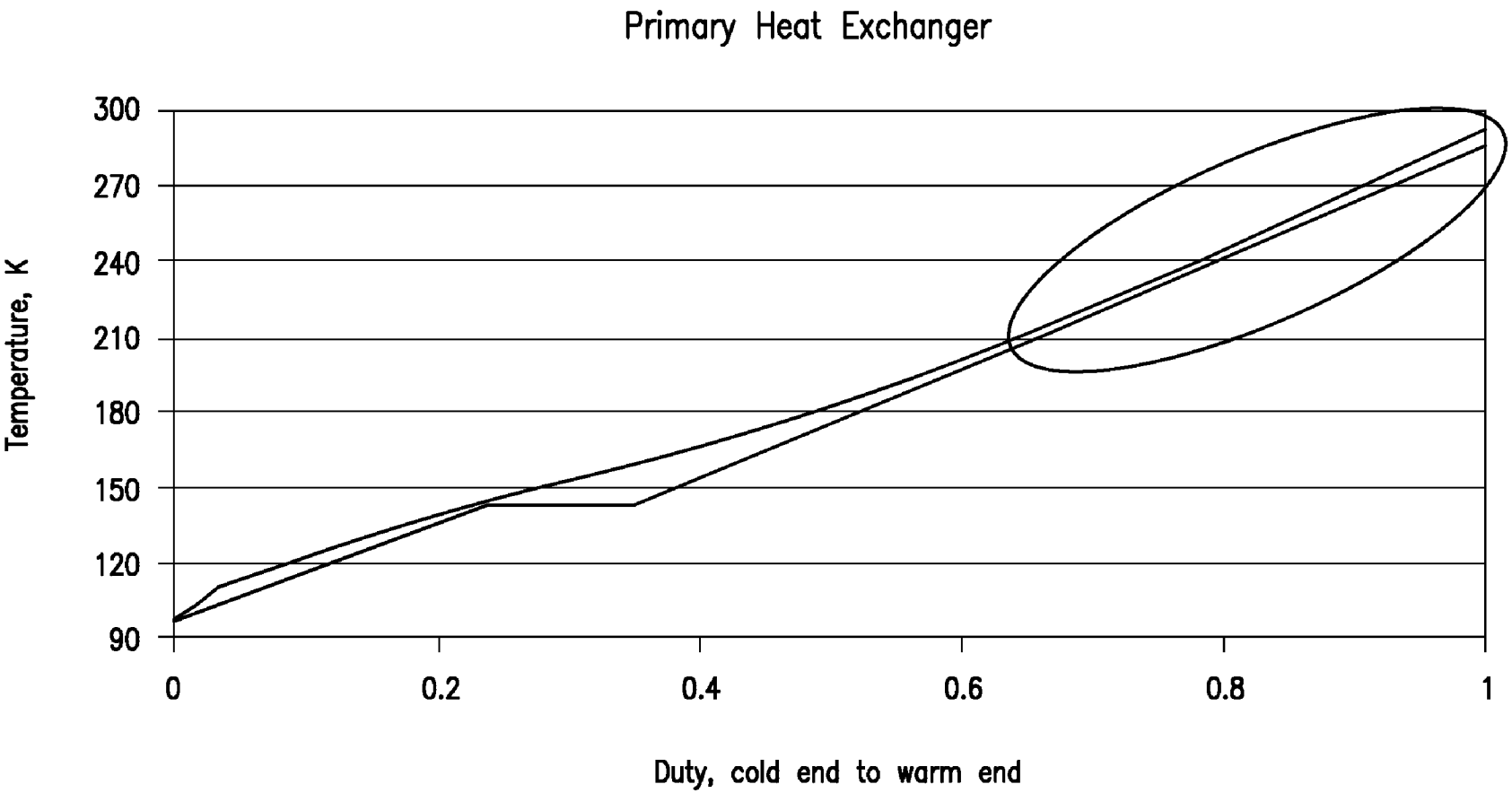
FIG. 6 is a graphical representation of the cooling curve for the main heat exchanger in the practice of the cryogenic air separation system of this invention illustrated in FIG. 1.

The cooling curve for heat exchanger 50 shown in FIG. 6 demonstrates how the addition of warm turbine 24 enables higher liquid production. In the circled part of the cooling curve, it can be seen that the warming and cooling temperature profiles pinch and then begin to open at warmer temperature levels. This is a result of the refrigeration provided by the warm turbine. The minimum pinch temperature here corresponds to the point where the warm turbine exhaust stream 94 feeds heat exchanger 50. Without the warm turbine refrigeration, the temperature profiles for the warming and cooling streams would cross over rather than open up at the higher temperatures in the heat exchanger. This means that the same amount of liquid make could not be produced without a large increase in cold turbine 14 flow. The increase in cold turbine flow would result in very poor argon and oxygen recovery. Also, a second cold turbine (in parallel) would be necessary to handle the large range in flow. It is much more effective to have the warm turbine as the second turbine, providing the refrigeration at the warm temperature level where it is most needed. Producing refrigeration at warm temperatures is very efficient if it can be done effectively, as is the case here.

Figure 3:
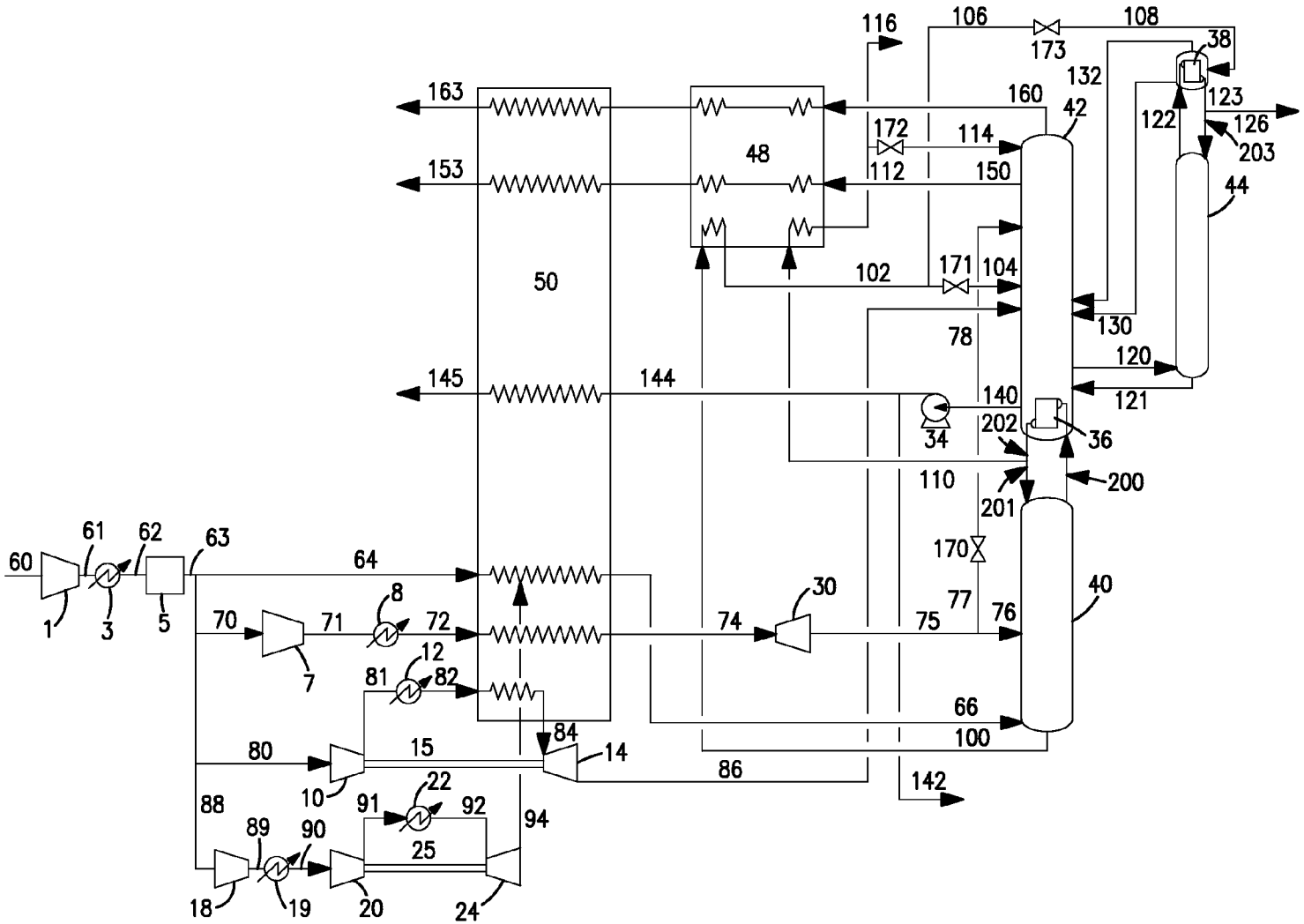

The FIG. 3 embodiment is the most preferred configuration for a retrofit case. It differs from FIG. 1 in that a separate compressor (18) raises the pressure of stream 90 before it is fed to the warm booster and turbine (20 and 24). It is unlikely that compressor 7, if originally designed without an interstage takeoff stream, could be modified economically to handle the withdrawal of stream 90 from its desired interstage location for a retrofit. The best alternative is then to use additional compressor 18 to raise the air pressure to the desired level for the warm turbine/booster. Compressor 18 is preferably one or two stages, depending on the desired pressure ratio across the warm turbine. Cooler 19 removes the heat of compression from stream 89 before it is fed to booster 20.

Figure 4:
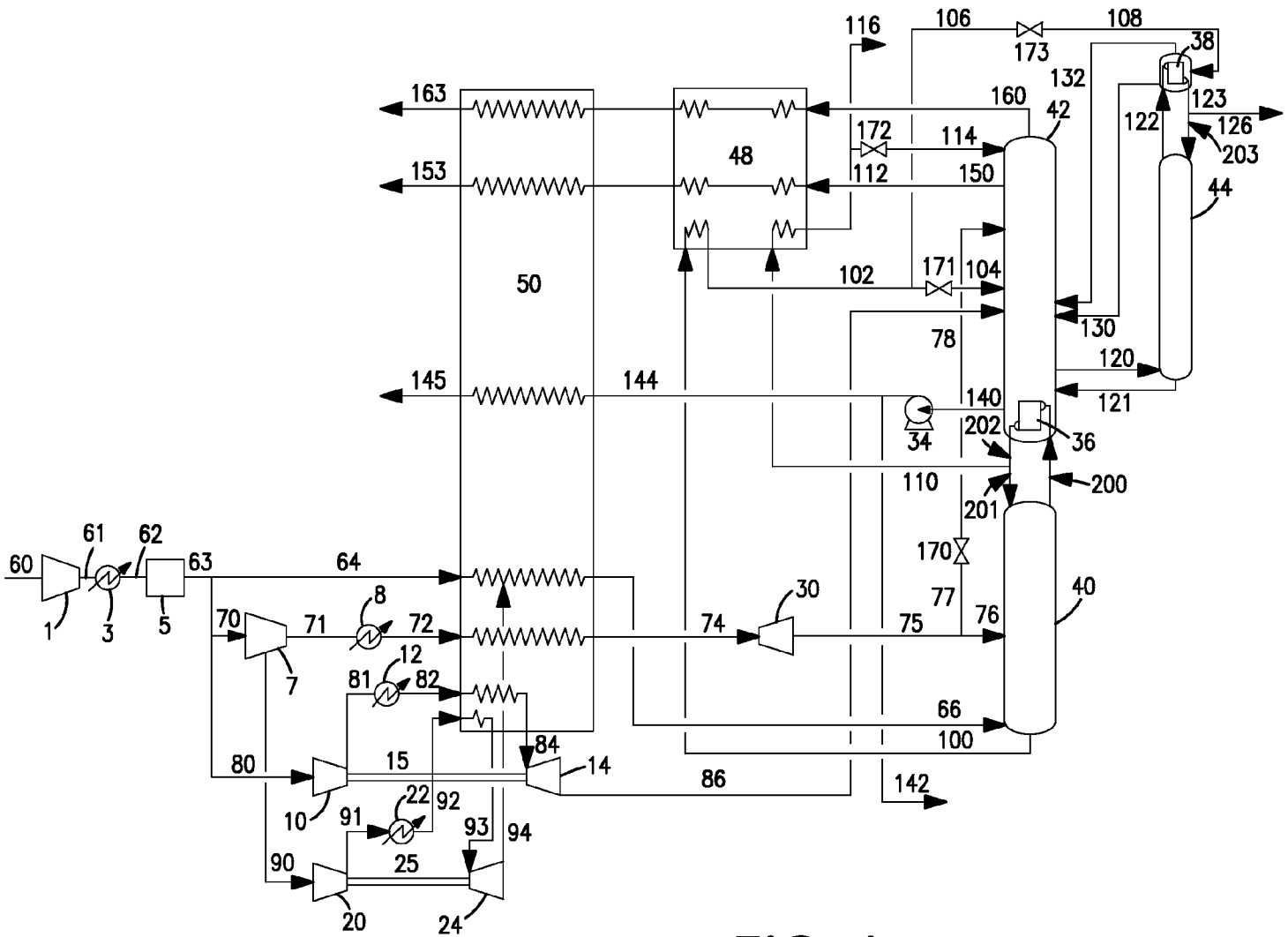

FIG. 4 is similar to FIG. 1, except that stream 93, the feed to turbine 24, is cooled some amount below ambient temperature by partial cooling in heat exchanger 50. This is necessary only to effectively produce higher amounts of liquid than can normally be produced by the FIG. 1 embodiment. In such a case, the cold turbine flow (turbine 14) in FIG. 1 becomes unmanageably large. This indicates that at these higher liquid rates, refrigeration is needed at a lower temperature level than can be provided by operating turbine 24 with an ambient temperature level feed. By partially cooling stream 93, the additional turbine refrigeration can again be provided effectively (and more efficiently) at a higher temperature level than the cold turbine, while at a low enough temperature to enable the further increased liquid production. It also will reduce the warm end temperature difference of heat exchanger 50, reducing the resultant refrigeration loss that occurs with ambient level turboexpansion. This embodiment may be needed also to economically use the warm turbine for low oxygen boiling pressures, or in a cycle without oxygen boiling.

Figure 5:
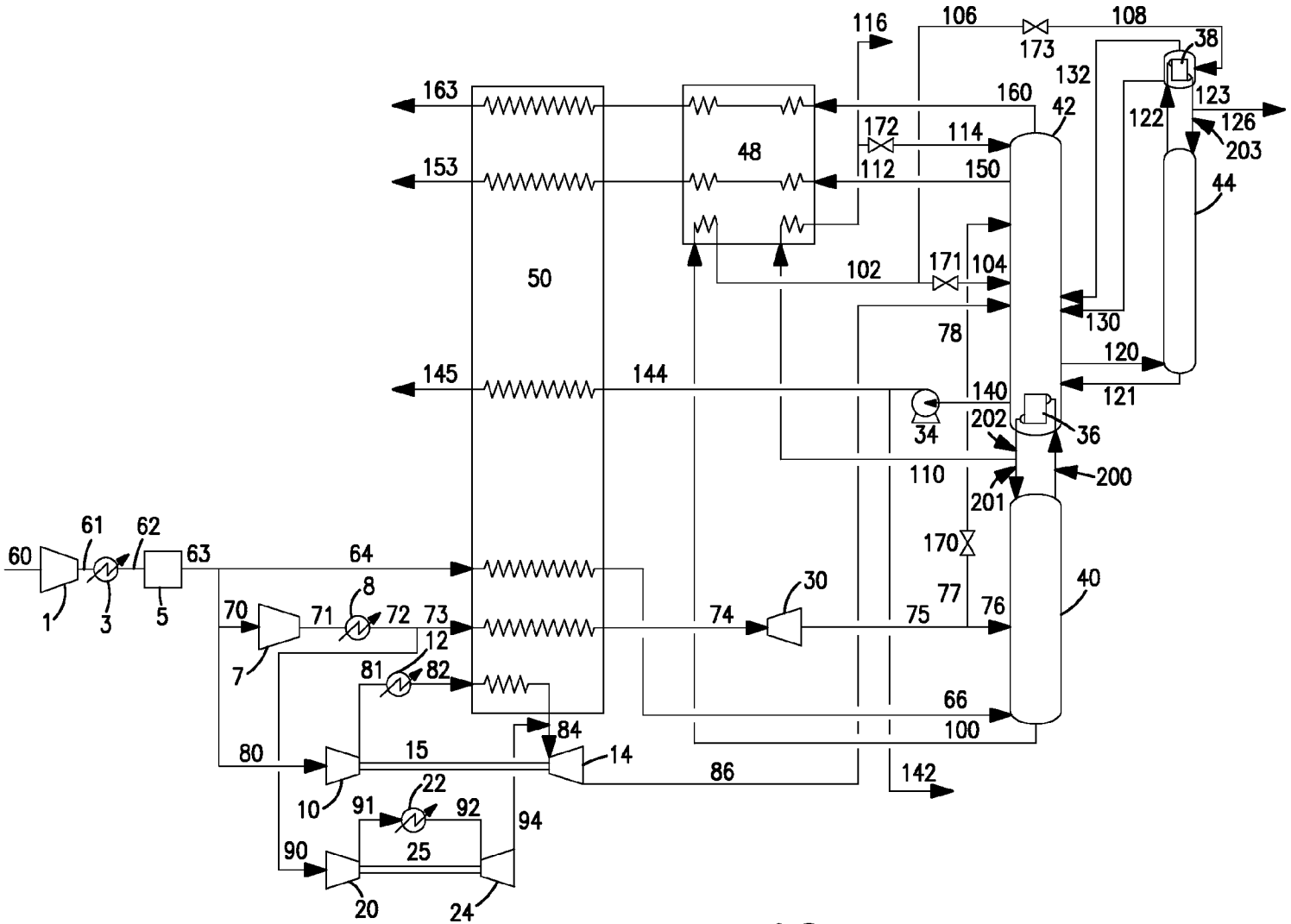

The key feature of the embodiment illustrated in FIG. 5 is that exhaust stream 94 feeds boosted cold turbine 14 in combination with the intermediate stream from heat exchanger 50. Turbine 24 now is in series with turbine 14. Usually this means that the pressure of stream 94 is higher, which also means that the pressures of streams 91, 92 and 90 are higher than in the FIG. 1 embodiment. This is why stream 90 is shown being withdrawn as a split stream from the discharge of compressor 7 after cooler 8. This is dependent on the discharge pressure of compressor 7, however, and it could still be desirable to withdraw stream 90 from an interstage location of compressor 7. This configuration may be used when it is not practical to feed stream 94 to an intermediate location in heat exchanger 50. An example would be a retrofit of a plant without heat exchanger 50 pre-designed with a side nozzle and distributor to accept the warm turbine exhaust stream. This configuration usually leads to extra flow through turbine 14.

Although the invention has been described in detail with reference to certain preferred embodiments, those skilled in the art will recognize that these are other embodiments within the spirit and the scope of the claims.

The invention claimed is:

1. A method for operating a cryogenic air separation plant employing a double column having a higher pressure column and a lower pressure column for rectifying feed air to produce a liquid product, said method comprising:

compressing a main feed air stream composed of the feed air to produce a compressed main feed air stream, cooling a part of the compressed main feed air stream in a main heat exchanger and introducing the compressed main feed air stream into the higher pressure column;

further compressing a first gas stream composed of another part of the main feed air stream, partially cooling the first gas stream within the main heat exchanger, passing at least the first gas stream at a first temperature of from 125K to 200K to a cold turbine, turboexpanding the first gas stream in the cold turbine to a pressure no greater than 3 psi higher than the operating pressure of the lower pressure colunm to produce a turboexpanded gas stream, and passing the turboexpanded gas stream into the lower pressure column;

further compressing a second gas stream, composed of yet another part of the compressed main feed air stream, the second gas stream being further compressed, at least in part, in a booster compressor and without being cooled in the main heat exchanger, removing heat of compression from the second air stream after passage through the booster compressor and then passing the second air stream at a second temperature of from 200K to 320K to a warm turbine driving the booster compressor, turboexpanding the second gas stream in the warm turbine to a pressure no lower than the operating pressure of the higher pressure column, and passing the turboexpanded second gas stream into least one of the cold turbine along with the first gas stream and an intermediate location of the main heat exchanger and thereafter the higher pressure column; and modulating flow of the second gas stream or pressure ratio across the warm turbine to vary production of the liquid product.

2. The method of claim 1 wherein at least some oxygen product is recovered as the liquid product from the cryogenic air separation plant.

3. The method of claim 1 wherein at least some nitrogen product is recovered as the liquid product from the cryogenic air separation plant.

4. The method of claim 1 further comprising an argon column, passing fluid from the lower pressure column to the argon column, and recovering argon product from the argon column.

5. The method of claim 4 wherein at least some of the recovered argon product is recovered as the liquid product.

6. The method of claim 1 wherein the second temperature is from 280K to 320K.

7. The method of claim 1 wherein the operation of the warm turbine is turned on and off during the time the cold turbine is operating to modulate the flow to the warm turbine.

* * * * *